US005343880A

United States Patent [19]

McKay

[11] Patent Number: 5,343,880

[45] Date of Patent: Sep. 6, 1994

[54] FLUID DISPENSING WAND

[76] Inventor: William D. McKay, 528 Kelso St., Flint, Mich. 48506

[21] Appl. No.: 932,891

[22] Filed: Aug. 19, 1992

Related U.S. Application Data

[63] Continuation-in-part of Ser. No. 917,854, Jul. 17, 1992.

[51] Int. Cl.[5] ..... A45D 24/22

[52] U.S. Cl. ..... 132/116; 132/112; 132/115

[58] Field of Search ..... 132/108, 112, 113, 114, 132/115, 116, 150, 110, 111; 401/134, 280, 281

[56] References Cited

U.S. PATENT DOCUMENTS

| | | | |
|---|---|---|---|
| 85,311 | 12/1869 | Kerr, Jr. et al. | 132/113 |
| 792,124 | 6/1905 | Evans | 132/114 |
| 1,059,282 | 4/1913 | De Bassini . | |
| 1,408,262 | 2/1922 | Brueck et al. . | |
| 1,449,096 | 3/1923 | Grieten | 132/114 |
| 1,487,374 | 3/1924 | De Bassini | 132/108 |
| 1,615,581 | 1/1927 | Harris | 401/134 |
| 1,823,850 | 9/1931 | Marshall . | |
| 1,829,021 | 10/1931 | Sinclair | 132/113 |
| 1,876,033 | 9/1932 | Starr | 132/113 |
| 2,101,132 | 12/1937 | Daly et al. | 132/112 |
| 2,108,184 | 2/1938 | Wallenius | 132/116 |
| 2,148,966 | 2/1939 | Schmidt | 132/13 |
| 2,336,717 | 12/1943 | Crimmins | 401/281 |
| 2,594,721 | 4/1952 | Beebe | 132/116 |
| 2,596,296 | 5/1952 | Shields | 132/18 |
| 2,608,976 | 9/1952 | Kittle et al. | 132/150 |
| 2,609,821 | 9/1952 | Weissberger | 132/116 |
| 2,737,190 | 3/1956 | Magnuson et al. | 132/114 |
| 2,794,443 | 6/1957 | Moore | 132/113 |
| 3,147,757 | 9/1964 | Hofmann | 132/114 |
| 3,295,537 | 1/1967 | Young, Jr. | 132/113 |
| 3,429,642 | 2/1969 | Underwood | 132/116 |
| 3,446,216 | 5/1969 | Sala | 132/116 |
| 3,456,658 | 7/1969 | Long, Jr. | 132/116 |
| 3,463,170 | 8/1969 | McCullough | 132/113 |
| 3,520,311 | 7/1970 | Iesersele et al. | 132/116 |
| 3,683,942 | 8/1972 | McKay | 132/112 |
| 3,818,917 | 6/1974 | Hudson | 132/116 |
| 3,908,679 | 9/1975 | Wright | 132/116 |
| 4,090,522 | 5/1978 | Donley et al. | 132/112 |
| 4,209,027 | 6/1980 | Morgenroth | 401/281 |
| 4,317,464 | 3/1982 | Bailey et al. | 132/113 |
| 4,585,018 | 4/1986 | O'Connor | 132/120 |
| 4,747,420 | 5/1988 | Alaimo | 132/112 |
| 4,792,250 | 12/1988 | Turner | 132/112 |

FOREIGN PATENT DOCUMENTS

| | | | |
|---|---|---|---|
| 7460 | of 1907 | United Kingdom | 132/114 |
| 299732 | 10/1928 | United Kingdom | 132/108 |

*Primary Examiner*—Gene Mancene
*Assistant Examiner*—Frank A. LaViola
*Attorney, Agent, or Firm*—Stetina and Brunda

[57] ABSTRACT

A fluid dispensing wand having a fluid reservoir removably attachable to a wand for applying a fluid such as hair oil, coloring, lightener, highlight, detangler, or conditioner to the hair. A fluid delivery means disperses fluid from the reservoir throughout the wand to effect even distribution of the fluid throughout the hair. The fluid delivery means comprises a series of conduits and/or a porous material. Teeth and/or fins are formed upon the wand such that the wand may be moved through the hair in a comb-like fashion to effect transfer of the fluid thereto. An absorbent covering may optionally be formed over the wand intermediate the teeth or fins to further enhance the even distribution of fluid. A plug or seal preferably closes the reservoir, thus providing a fluid cartridge. Thus, various cartridges may be installed upon the wand to effect application of various desired fluids to the hair. Several valve arrangements for selectively facilitating fluid communication between the reservoir and wand are disclosed. In additional configurations, fluid is pumped, via a plunger or bulb, from the reservoir to the wand.

12 Claims, 6 Drawing Sheets

10a
12a
28a
36a
29a
26a
30a
32a
27a
34a
20a
14a
18a
16a
19

37a 22a
24a

Fig. 4
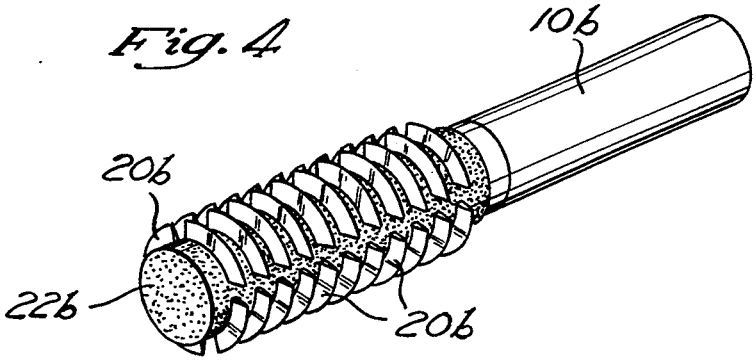
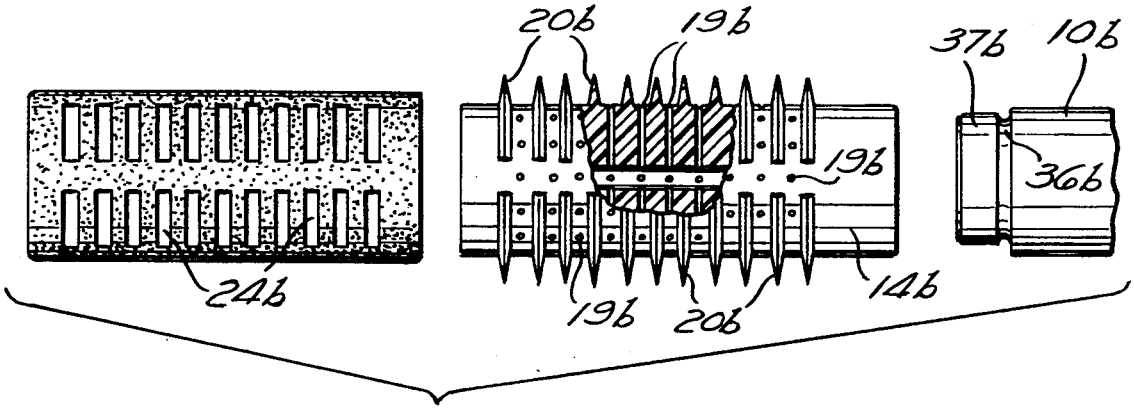
Fig. 5
Fig. 6
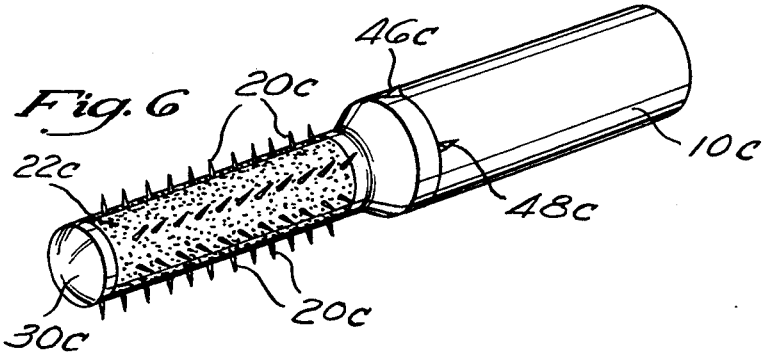
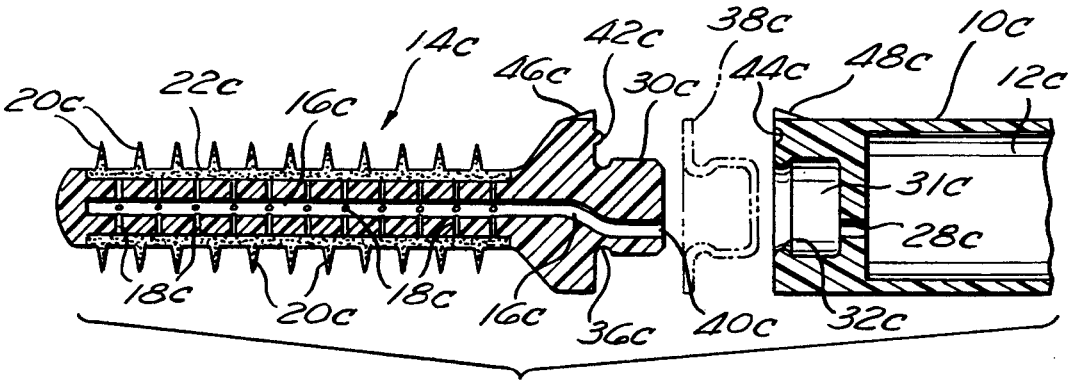
Fig. 7

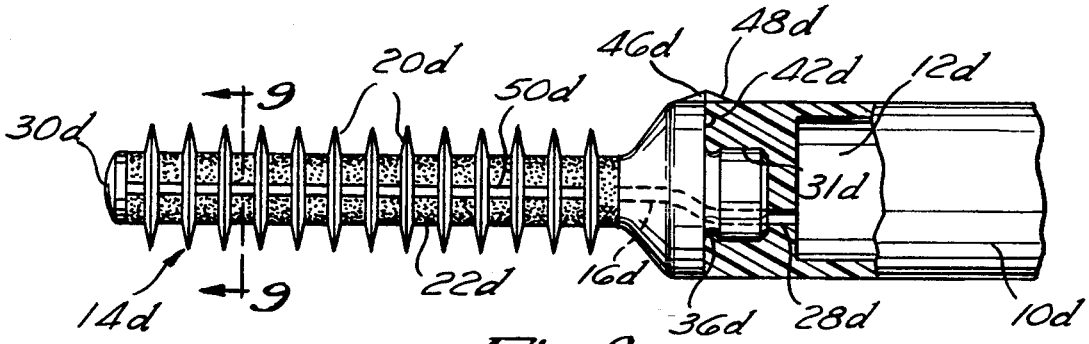
Fig. 8
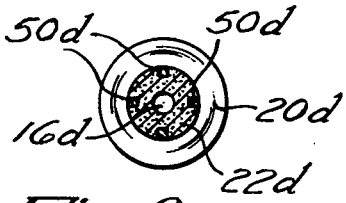
Fig. 9
Fig. 10
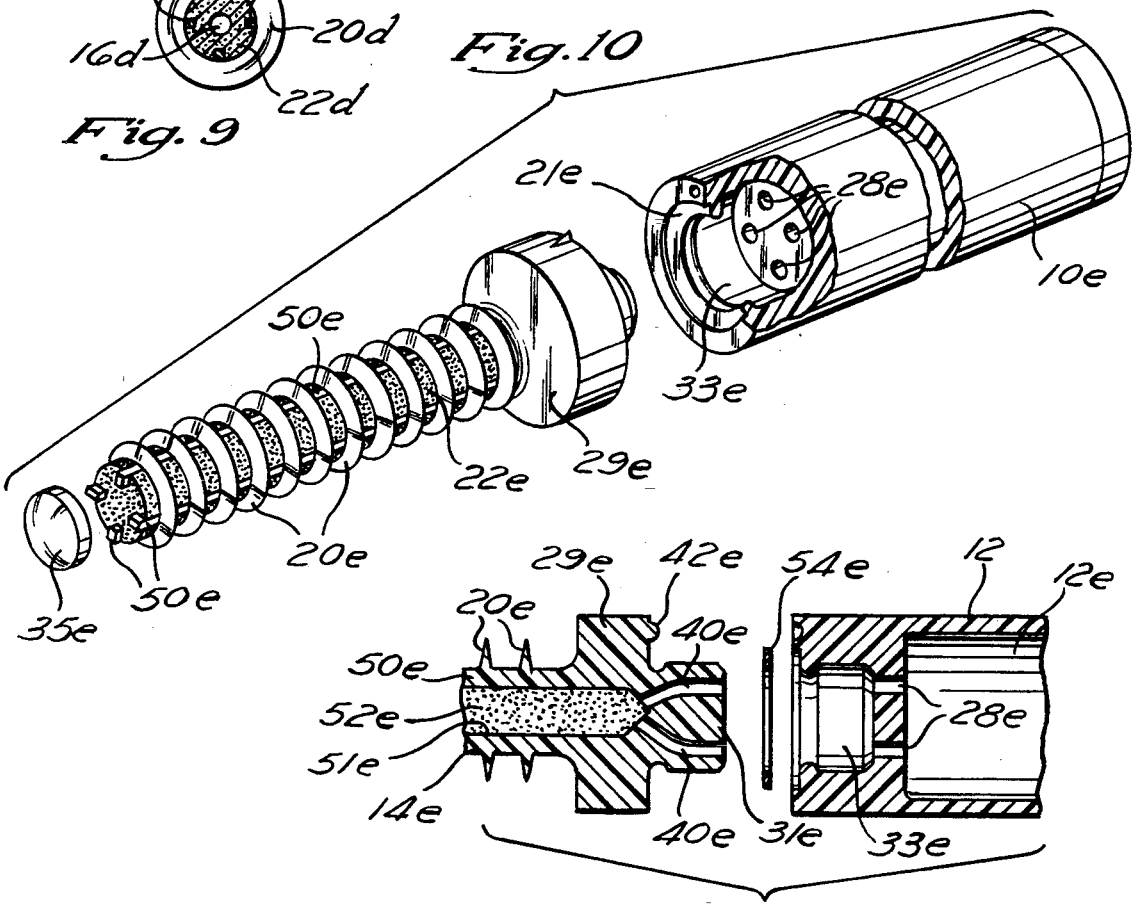
Fig. 11

Fig. 12
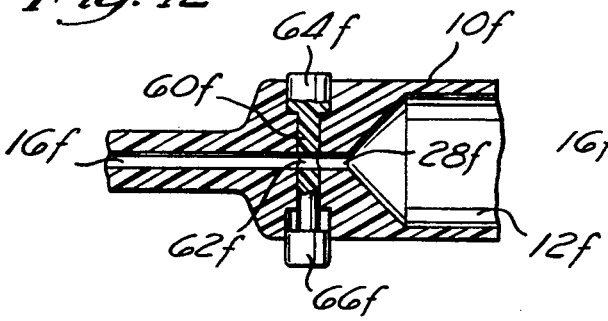
Fig. 13
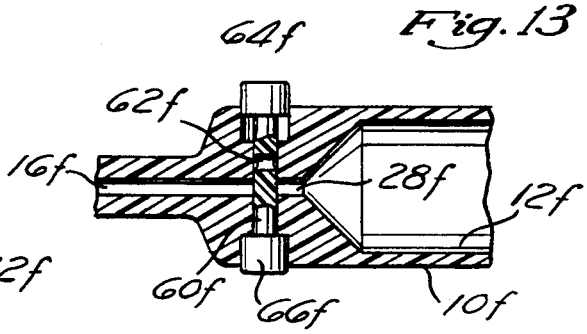
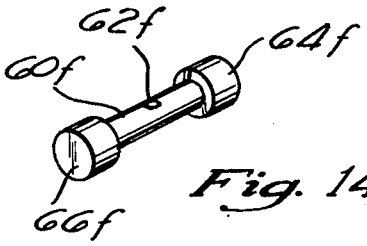
Fig. 14
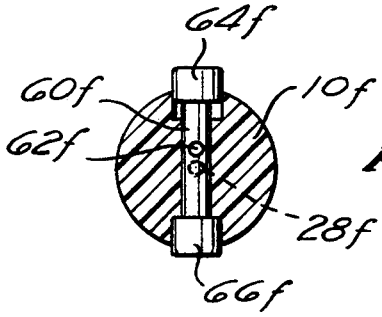
Fig. 15
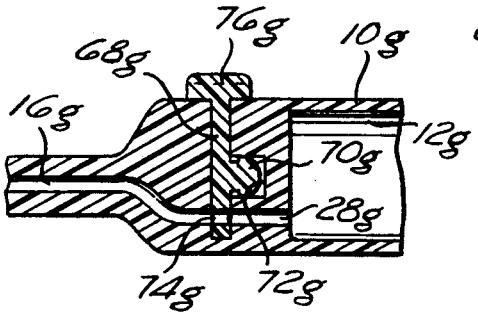
Fig. 16
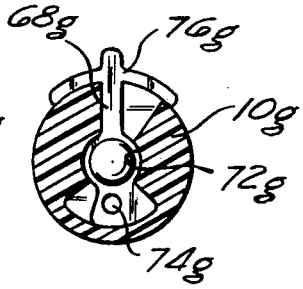
Fig. 17
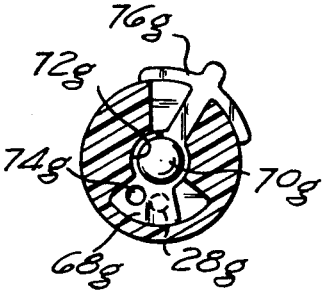
Fig. 18
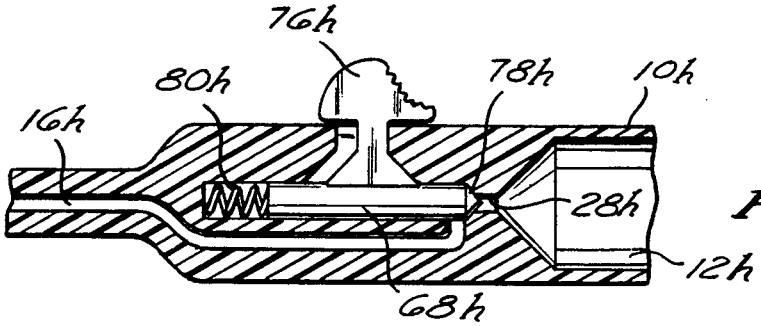
Fig. 19
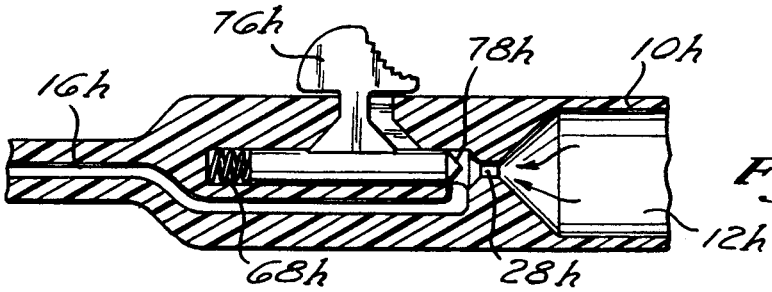
Fig. 20

Fig. 21
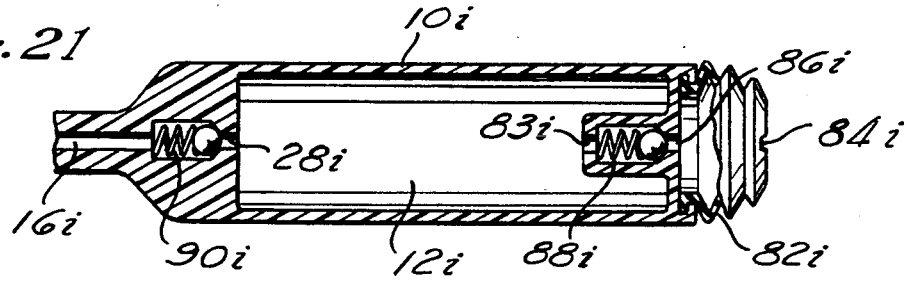
Fig. 22
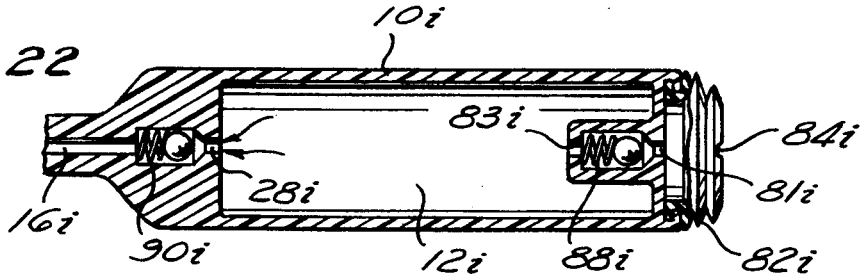
Fig. 23
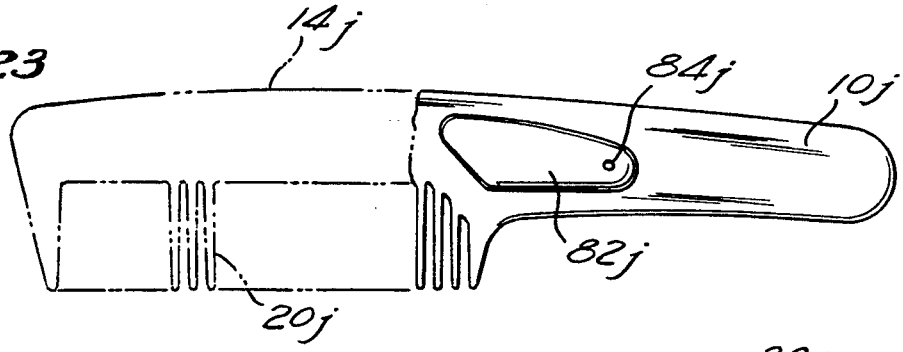
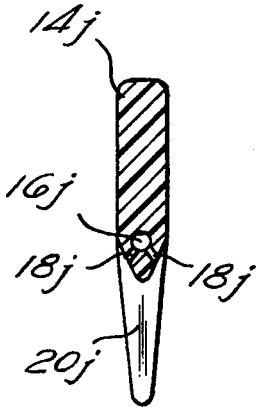
Fig. 24
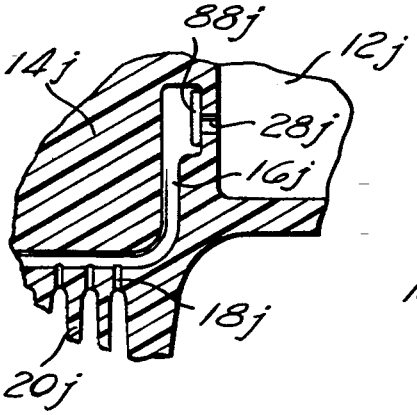
Fig. 25
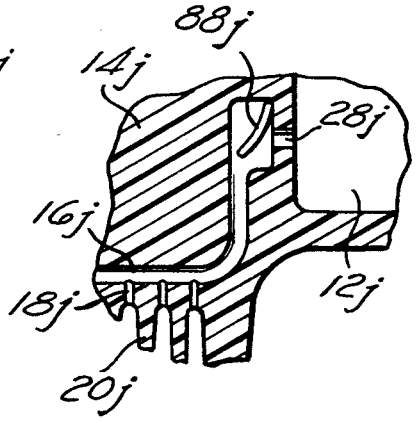
Fig. 26

Fig. 27
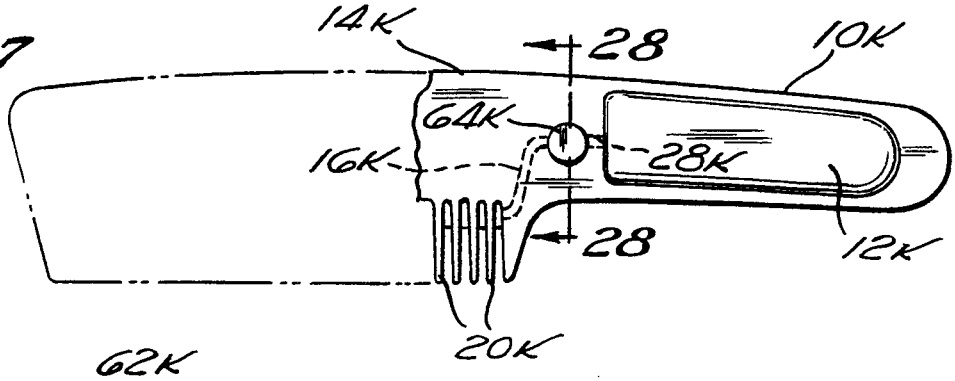
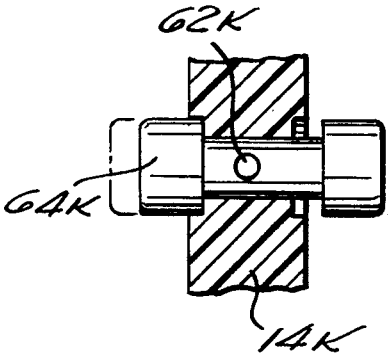
Fig. 28

FLUID DISPENSING WAND

RELATED APPLICATIONS

The subject patent application is a continuation-in-part application of copending U.S. patent application Ser. No. 07/917,854, filed Jul. 17, 1992, pending and entitled FLUID DISPENSING COMB, the contents of which are expressly incorporated herein by reference.

FIELD OF THE INVENTION

The present invention relates generally to fluid dispensing apparatus and more particularly to a fluid dispensing wand having a reservoir for storing and dispensing hair oil, conditioner, coloring, lightener, highlight, gloss, detangler or the like directly upon a user's hair.

BACKGROUND OF THE INVENTION

It is well known to apply various liquids, i.e. hair oil, conditioner, hair coloring, lightener, highlight, gloss, detangler, and the like, to the hair to promote hair health and to improve hair appearance. Such fluids are typically applied by being dispensed from their container onto one's hair, e.g. sprayed or poured on, and then being manually dispersed through the hair with one's hands or with a paintbrush-style tool. Such manual dispersion of the fluid through one's hair inherently possesses substantial disadvantages. For instance, it generally requires that the user's hands come into direct contact with the fluid. This is particularly undesirable in many instances wherein the fluid being dispersed may discolor or otherwise have an undesirable effect upon the skin and/or fingernails of the user's hands.

Furthermore, once a user's hands have come into contact with such a fluid, it is extremely difficult to avoid transferring the fluid to the user's clothing and/or other nearby objects. This is due to the frequency and habitual nature of utilizing one's hands in the performance of essentially all manual tasks.

For example, one may reach into one's pocket prior to remembering that one's hands have contacted the fluid, thus soiling one's clothing. This is particularly crucial in those instances where a fluid such as hair coloring is being applied to one's hair and has come into contact with one's hands. Such hair colorings may potentially discolor or stain clothing, towels, or other items or fabrics with which they come into contact.

Thus, although the prior art method of dispensing such fluids has proven generally suitable for its intended purpose, the process possesses inherent deficiencies which detract from its overall desirability and effectiveness. In view of the shortcomings of the prior art, it is therefore desirable to provide a means for dispensing such fluids which does not require the user to manually disperse the fluids throughout the hair by utilizing the hands.

SUMMARY OF THE INVENTION

The present invention specifically addresses and alleviates the above-mentioned deficiencies associated in the prior art. More particularly, the present invention comprises a fluid dispensing wand for applying fluids such a hair oil, coloring, lightener, highlight, detangler, or conditioner to the hair. The present invention comprises a fluid reservoir which defines a handle for the device and a dispensing means or wand removably attachable to and in fluid communication with the reservoir. The wand includes teeth or fins formed thereon for dispensing the fluid throughout the user's hair. That is, the teeth or fins allow the wand to be moved through the hair in a comb-like fashion to effect transfer of the fluid thereto. The fluid dispensing wand thus facilitates the application of a desired fluid, such as hair oil, coloring, lightener, highlight, detangler, or conditioner to the hair without requiring that the user's hands contact the fluid.

A fluid delivery means disperses fluid from the reservoir throughout the wand to effect even distribution of the fluid throughout the hair. The fluid delivery means may comprise either a series of channels or a porous material formed within, upon, or about the wand. An absorbent covering may optionally be formed over the wand intermediate the teeth or fins to further enhance the even distribution of fluid.

A seal preferably closes the reservoir, thus providing a fluid-containing cartridge. Various such cartridges may be utilized to effect application of various desired fluids to the hair. Thus, a particular or given wand may be utilized with a variety of different cartridges, each cartridge containing a different fluid to effect a different desired hair treatment.

A valve means may optionally be utilized to selectively control the flow of fluid from the reservoir to the fluid delivery means of the wand. In a first configuration of the valve means, rotation of the handle or reservoir relative to the wand effects alignment of at least one fluid conduit in the handle with a complimentary fluid conduit in the wand to provide fluid communication therebetween.

In a second configuration of the valve means, manipulation of a button upon the handle moves a slide to a position wherein an aperture formed in the slide aligns with a fluid conduit to effect the flow of fluid therethrough. Manipulation of an opposing button moves the aperture out of alignment with the fluid conduit such that fluid flow is halted.

In a third configuration of the valve means, a slide is pivotally rotated to affect similar alignment or misalignment of an aperture formed therein with the fluid conduit.

In a fourth configuration of the valve means, movement of a slide in a first direction removes a plug from a fluid conduit to facilitate fluid flow from the reservoir, while movement of the slide in a second direction plugs the fluid conduit leading to the reservoir.

In additional configurations of the present invention, fluid is pumped, via a plunger or bulb, from the reservoir to the wand. Depressing or squeezing the plunger forces air into the reservoir, preferably through a check valve, and consequently forces fluid from the reservoir, again preferably through a check valve, and into the fluid delivery means of the wand.

These, as well as other advantages of the present invention will be more apparent from the following description and drawings. It is understood that changes in the specific structure shown and described may be made within the scope of the claims without departing from the spirit of the invention.

BRIEF DESCRIPTION OF THE DRAWINGS

FIG. 4 is a perspective view of a second embodiment of the fluid dispensing wand of the present invention;

FIG. 5 is an exploded side view, partially in cross-section, of the second embodiment of the fluid dispensing wand of FIG. 4;

FIG. 6 is a perspective view of a third embodiment of the fluid dispensing wand of the present invention;

FIG. 7 is an exploded side view of the third embodiment of the fluid dispensing wand of FIG. 6;

FIG. 8 is a side view of a fourth embodiment of the fluid dispensing wand of the present invention;

FIG. 9 is an end view of the fluid dispensing wand of FIG. 8 showing the distal end thereof with the cap removed therefrom;

FIG. 10 is an exploded perspective view of a fifth embodiment of the fluid dispensing comb of the present invention;

FIG. 11 is an exploded cross-sectional side view of the fifth embodiment of the fluid dispensing comb of FIG. 10;

FIG. 12 is a cross-sectional side view of a first configuration of a valve means for controlling the flow of fluid from the reservoir to the fluid delivery means of any embodiment of the fluid dispensing comb of the present invention, showing the valve means in the open position;

FIG. 13 is a cross-sectional side view of the valve means of FIG. 12 showing the valve means in the closed position;

FIG. 14 is a perspective view of the valve member;

FIG. 15 is a cross-sectional end view of the valve means of FIGS. 12–14;

FIG. 16 is a cross-sectional side view of a second configuration of a valve means for controlling the flow of fluid from the reservoir to the fluid delivery means of any embodiment of the fluid dispensing comb of the present invention, showing the valve means in the open position;

FIG. 17 is a cross-sectional end view of the valve means of FIG. 16 showing the valve means in the open position;

FIG. 18 is a cross-sectional end view of the valve means of FIG. 16 showing the valve means in the closed position;

FIG. 19 is a cross-sectional side view of a third configuration of a valve means for controlling the flow of fluid from the reservoir to the fluid delivery means of any embodiment of the fluid dispensing comb of the present invention, showing the valve means in the closed position;

FIG. 20 is a cross-sectional side view of the valve means of FIG. 12 showing the valve means in the open position;

FIG. 21 is a cross-sectional side view of an additional configuration of the reservoir for any embodiment of the fluid dispensing wand of the present invention wherein a pump effects the flow of fluid from the reservoir to the fluid delivery means thereof, showing the pump in the expanded or non-pumping position;

FIG. 22 is a cross-sectional side view of the pump of the configuration of FIG. 21, showing the pump in the compressed or pumping position;

FIG. 23 is a side view of a further configuration of the reservoir of any embodiment of the fluid dispensing wand of the present invention, and additionally illustrating its applicability to a comb;

FIG. 24 is a cross-sectional end view of the configuration of FIG. 23;

FIG. 25 is an enlarged cross-sectional side view of a check valve of the further configuration of FIG. 23;

FIG. 26 is an enlarged cross-sectional side view of the check valve of FIG. 25;

FIG. 27 is a side view of a further configuration of the reservoir of any embodiment of the fluid dispensing wand of the present invention, and additionally illustrating its applicability to a comb, utilizing a valve means to control the flow of fluid from the reservoir to the fluid delivery means; and FIG. 28 is an enlarged cross-sectional end view of the valve means of FIG. 27 taken about lines 28—28 of FIG. 27.

DETAILED DESCRIPTION OF THE PREFERRED EMBODIMENT

Figures 1, 2, 3:
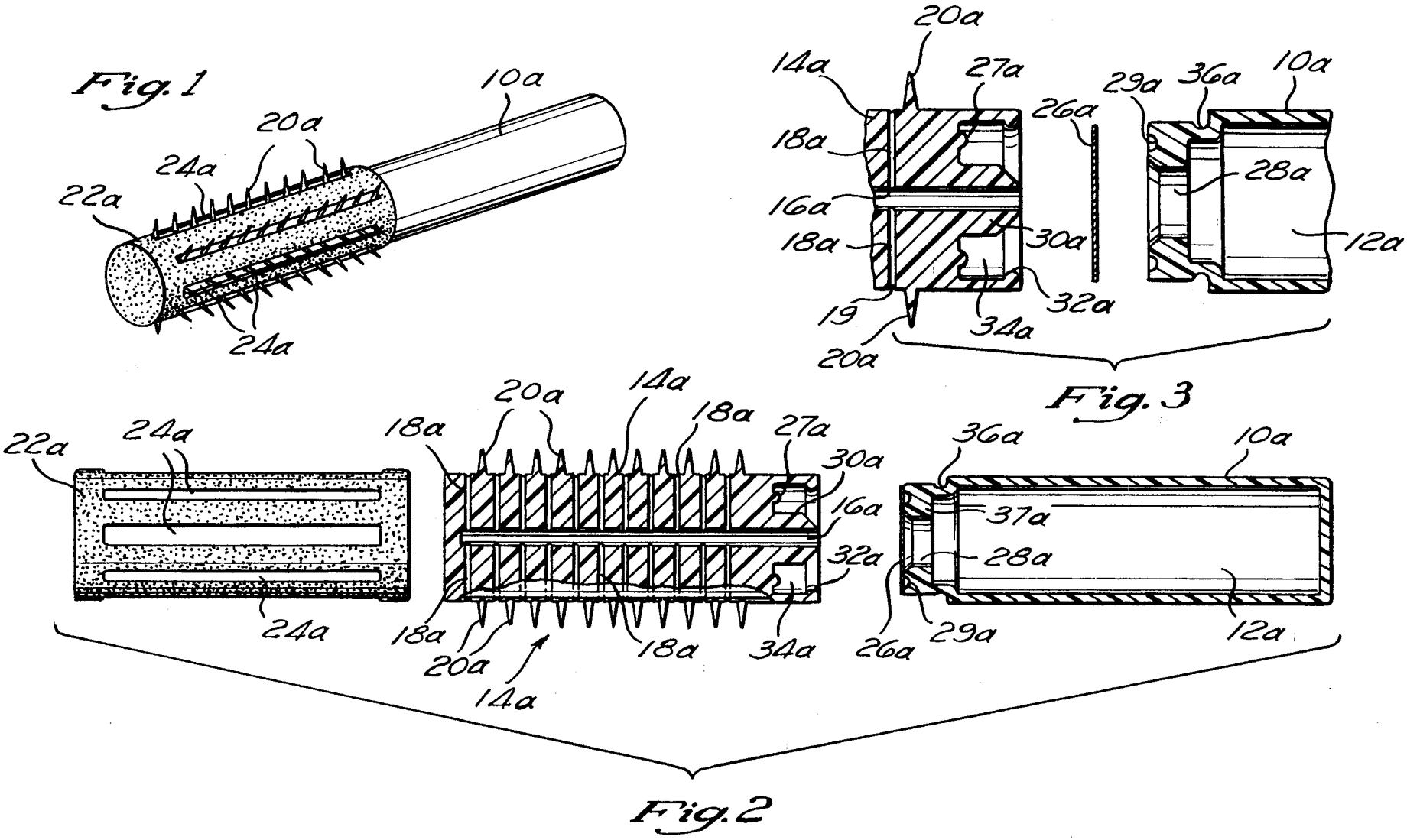
FIG. 1 is a perspective view of a first embodiment of the fluid dispensing wand of the present invention.
FIG. 2 is an exploded side view, partially in cross-section, of the first embodiment of the fluid dispensing wand of FIG. 1.
FIG. 3 is an enlarged cross-sectional side view of the interconnecting portions of the wand and reservoir of FIG. 2.

The detailed description set forth below in connection with the appended drawings is intended as a description of the presently preferred embodiments of the invention and is not intended to represent the only forms in which the present invention may be constructed or utilized. The description sets forth the functions and sequence of steps for constructing and operating the invention in connection with the illustrated embodiments. It is to be understood, however, that the same or equivalent functions and sequences may be accomplished by different embodiments that are also intended to be encompassed within the spirit and scope of the invention.

The fluid dispensing wand of the present invention is illustrated in FIGS. 1–28 which depict five presently preferred embodiments of the invention. Referring now to FIGS. 1–3, the first embodiment of the fluid dispensing wand of the present invention is comprised generally of a handle 10*a* containing a fluid reservoir 12*a* and removably attachable to a wand 14*a*. A fluid delivery means preferably comprise a longitudinal channel 16*a* and a plurality of radial conduits 18*a* formed within the wand 14*a* and provides fluid communication from the reservoir 12*a* to a plurality of teeth 20*a* formed upon the outer surface of the wand 14*a*.

An absorbent covering 22*a* having a plurality of longitudinally extending slots or openings 24*a* formed therein substantially envelops the wand 14*a* such that the teeth 20*a* thereof extend through the slots or openings 24*a* in the absorbent covering 22*a*. The absorbent covering 22*a* thereby prevents excessive flow of fluid from openings 19 of the radial conduits 18*a* of the fluid dispensing means and additionally facilitates even distribution of the fluid about the wand 14*a*.

A thin membrane or foil seal 26*a* preferably covers a fluid conduit 28*a* extending into the fluid reservoir 12*a*, thereby sealing fluid within the fluid reservoir 12*a* of the handle 10*a*. A protuberance 30*a* through which a portion of longitudinal conduit 16*a* extends, is configured to tear or puncture the seal 26*a* during interconnection of the handle 10*a* and wand 14*a* such that fluid intercommunication is provided between the reservoir 12*a* and the fluid delivery means comprised of the longitudinal conduit 16*a* and the radial conduits 18*a*.

Detent means, preferably comprised of annular male detent 32*a* formed proximate recess 34*a* of wand 14*a* engages corresponding annular female detent 36a formed upon the distal end of handle 10a to effect secure attachment of the wand 14a to the handle 10a. Annular protuberance 27a is received by complimentary annular groove 29a to provide a fluid-tight seal of the protuberance 30a within the bore 28a of the handle 10a and thus facilitates leak-free interconnection of the wand 14a and handle 10a.

The teeth 20a are used in a comb-like fashion to spread or disperse fluid from the wand.

Referring now to FIGS. 4 and 5, in a second embodiment of the fluid dispensing wand of the present invention, the teeth 20a of the first embodiment thereof are replaced with corresponding fins 20b and the longitudinal slots or openings 24a in the absorbent covering 22b are replaced with complimentary lateral slots or openings 24b, configured to receive the fins 20b. The fins 20b of the second embodiment of the present invention are used in an analogous manner to the teeth of the first embodiment.

Referring now to FIGS. 5 and 7, in a third embodiment of the fluid dispensing wand of the present invention a first valve means facilitates selective control of fluid flow from the reservoir 12c to the fluid delivery means comprised of longitudinal conduit 16c and radial conduits 18c of the wand 14c. The first valve means is comprised of reservoir fluid conduit 28c, offset from the centerline of the handle 10c, which provides fluid communication from the fluid reservoir 12c to the distal end of the handle 10c.

Corresponding portion 40c of the longitudinal conduit 16c is likewise offset from the centerline of the wand 14c. Male member or protuberance 30c, formed upon the proximal end of wand 14c, is configured to be received within complimentary female member 31c formed upon the distal end of the handle 10c. Annular male detent 32c formed upon the handle 10c is received within complimentary annular female detent 36c formed upon the wand 14c such that the wand 14c is pivotally attached to the handle 10c and leak-free interconnection is achieved.

The wand 14c may be manually rotated relative to the handle 10c to either align the fluid conduit 28c of the handle 10c with the fluid conduit 40c of the wand and thereby facilitate fluid intercommunication between the reservoir 12c and the fluid delivery means comprised of the longitudinal conduit 16c and radial conduits 18c or conversely, the wand 14c may be selectively manually rotated relative to the handle 10c such that the fluid conduits 28c and 40c do not align and the flow of fluid from the fluid reservoir 12c to the fluid delivery means is not facilitated.

Plug 38c blocks fluid conduit 28c and prevents the undesired or inadvertent flow of fluid from the reservoir 12c prior to attachment of the wand 14c to the handle 10c. Thus, such plugged reservoir 12c define cartridges which may contain a variety of different fluids and which can be conveniently stored and transported, then utilized to disperse the fluid into the user's hair.

Female detent 44c formed in handle 10c receives corresponding male detent 42c formed upon the wand 14c to releasably lock the wand 14c in the flow permitting or "on" position relative to the handle 10c. A similar detent (not shown) may optionally releasably lock the wand 14c in the non-flow or off position relative to the handle 10c. Corresponding optional indicators 46c and 48c formed upon the wand 14c and handle 10c, respectively, indicate whether the wand 14c is in the flow permitting or non-flow permitting position relative to the handle 10c. Thus, alignment of first indicator 46c formed upon the proximal end of the wand 14c with similar indicator 48c formed upon the distal end of the handle 10c optionally indicates alignment of the conduit 28c of the handle 10c with the portion 40c of the longitudinal conduit 16c of the wand 14c such that fluid flow is effected.

Teeth 20c are formed upon absorbent covering 22c preferably as an integral portion thereof and may optionally comprise an absorbent material as well. Those skilled in the art will recognize that porous rigid material, such as POROX (a registered trademark of Porex Technologies, Fairburn, Ga.), is suitable for use as the absorbent material 22c and teeth 20c.

Referring now to FIGS. 8 and 9, in a fourth embodiment of the fluid dispensing wand of the present invention, fins 20d replace the teeth 20c of the third embodiment thereof. Spines 50d extend longitudinally along the wand 14d and facilitate rigid interconnection of the fins 20d to maintain the relative positioning thereof. End cap 30d interconnects the spines 50d and provides a nonabsorbent end piece for the wand 14d. Absorbent material 22d is provided intermediate adjacent fins 20d and either covers conduits 13c or fluid delivery means as in the third embodiment or optionally comprises substantially the entire wand including the fins 20d, thus eliminating the need for such radially extending conduits.

As in the third embodiment of the present invention, the alignment of an off-center conduit (not shown) on the wand 14d, with a corresponding off-center conduit on the handle 10d, facilitates the flow of fluid from the reservoir 12d to the wand 14d.

Referring now to FIGS. 10 and 11, in an additional configuration to the fourth embodiment of the fluid dispensing wand of the present invention, a plurality, preferably four, of fluid conduits 28e extend from the reservoir 12e and provide fluid communication to the corresponding four fluid conduits 40e formed at the proximal end of wand 14e. The use of such a plurality of fluid conduits 28e and 40e facilitates increased fluid flow. Absorbent wick 52e is disposed within the longitudinal conduit 51e in fluid communication with the value conduits 40e and radial conduits 53e to define a fluid delivery means. The absorbent wick is preferably comprised of Porex. Those skilled in the art will recognize that various other porous and/or absorbent materials are likewise suitable.

An O-ring or seal 54e is provided to insure fluid-tight fitting of the wand 14e to the handle 10e. Such a seal may optionally be utilized with any embodiment of the present invention wherein the wand is separable from the handle to prevent leakage of fluid therebetween.

Referring now to FIGS. 12–15, a second valve means for selectively controlling the flow of fluid from the reservoir 12f to the fluid delivery means of the wand is illustrated. The second valve means comprises a slide 60f having an aperture 62f formed therein such that the aperture 62f is aligned with the conduit 28f extending from the reservoir 12f when a first button 64f is depressed and is misaligned with the bore 28f when a second button 66f diametrically disposed relative to the first button 64f, is similarly depressed.

Referring now to FIGS. 16–18, a third valve means is illustrated. The third valve means preferably comprises a rotating gate or slide 68g attached to the handle 10g via pivot 70g which is received within an opening 72g formed in the handle 10g proximate the reservoir 12g. The slide 68g includes an aperture 74g formed therein which selectively aligns with conduit 28g extending from the fluid reservoir 12g when slide control 76g is disposed in a first position and which is misaligned with the conduit 28g when the slide 76g is disposed in a second position.

Referring now to FIGS. 19 and 20, a fourth valve means is illustrated. The fourth valve means comprises a slide 68h having a plug 78h which blocks the conduit 28h extending from the reservoir 12h when a slide control 76h attached thereto is disposed in a first position and which does not block the conduit 28h when the slide control 76h is moved to a second position against the urging of spring 80h. The slide control 76h must thus be held in the second position to maintain the flow of fluid from the reservoir 12h to the wand. Releasing the slide control 76h halts the flow of fluid from the reservoir 12h to the wand as the spring 80h urges the plug 78h into the conduit 28h.

Referring now to FIGS. 21 and 22, a first optional pump is illustrated. The optional pump comprises a squeeze bulb or bellows 82i having an air vent 84i formed therein and attached to the handle 10i such that air conduit 86i is in fluid communication with first check valve 88i, preferably of the spring and ball type, such that upon manually squeezing the bellows or squeeze bulb 82i air flow is effectuated through the air conduit 86i and first check valve 88i into air conduit 83i and further into the fluid reservoir 12i. A second check valve 90i, preferably of the spring and ball type, allows fluid to flow from the fluid reservoir 12i through conduit 28i and into the fluid delivery means or conduit 16i in response to the entry of air from the bellows 82i.

First check valve 88i prevents flow of fluid from the reservoir 12i into the bellows 82i when the bellows 82i is released and expands to its original position. Second check valve 90i similarly prevents the back flow of fluid from the fluid delivery means into the reservoir 12i as the bellows 82i expands.

Referring now to FIGS. 23–26, a fifth embodiment of the fluid dispensing wand of the present invention is illustrated. In the fifth embodiment of the present invention, the wand is configured as a comb wherein comb body 14j is formed having a handle 10j and plural teeth 20j extending therefrom. A fluid reservoir 12j (best seen in FIGS. 25 and 26) is disposed within the handle 10j. A squeeze bulb 82j having an air vent 84j formed therein is disposed upon at least one side of the handle 10j and defines an optional pump. A first flapper, reed, or check valve (not shown), allows air to flow into the squeeze bulb 82j and a second, flapper, reed, or check valve 88j facilitates the flow of fluid from the reservoir as in the first optional pump.

Referring now to FIGS. 27 and 28, an optional valve for the fifth embodiment of the fluid dispensing wand of the present invention is illustrated. The optional valve is comprised of a button 64k extending through the handle 10k such that it intersects the fluid conduit 28k extending from the fluid reservoir 12k in the manner of the valve illustrated in FIGS. 12 and 13. Thus, when disposed in a first position, a fluid conduit 62k facilitates fluid communication from the fluid reservoir 12k to the fluid delivery means 16k. When disposed in the second position, the button 64k blocks the flow of fluid from the reservoir 12k to the fluid delivery means 16k.

Each embodiment of the fluid dispensing comb of the present invention is utilized by attaching, if necessary, a fluid reservoir containing the fluid to be applied to the user's hair to the wand portion of the device and then using the fluid dispensing wand in a comb-like manner to spread the fluid throughout the user's hair. If utilized, the valve means is actuated to control the flow of fluid from the reservoir to the wand. Thus, the valve means prevents the excessive flow of fluid from the reservoir to the wand, thereby helping to prevent excessive buildup of the fluid upon the wand and consequent dripping of the fluid therefrom.

The optional pump, if provided, is actuated to ensure adequate flow of fluid from the fluid reservoir to the wand or fluid dispensing means as desired. The use of such a pump is particularly desirable when dispensing heavier or more viscous fluids to ensure adequate delivery thereof. When actuating the squeeze bulb or bellows of such a pump means, a finger is commonly placed over the air vent thereof as the squeeze bulb or bellows is compressed to ensure that air does not escape therefrom. The finger is removed from the air hole as the squeeze bulb or bellows expands to ensure adequate filling thereof with air.

It is understood that the exemplary fluid dispensing wands described herein and shown in the drawings represent only presently preferred embodiments of the invention. Indeed, various modifications and additions may be made to such embodiments without departing from the spirit and scope of the invention. For example, the bodies of each of the embodiments need not be configured precisely as described and depicted in the drawings. Rather, the bodies may be of any configuration which readily facilitate manipulation of the wand within the user's hair. Also, various configurations of the reservoirs are contemplated. Additionally, the various features of each embodiment or configuration of the fluid dispensing wand of the present invention may be interchanged as desired. Thus, these and other modifications in addition may be implemented to adapt the present invention for use in a variety of different applications.

What is claimed is:

1. A fluid dispensing wand for applying a fluid to the hair, said fluid dispensing wand comprising:

(a) a reservoir;

(b) a wand member attached to said reservoir, said wand member having fluid delivery means formed therein for providing fluid communication from the reservoir;

(c) pump means for effecting flow of fluid from said reservoir to said fluid delivery means, said pump means comprising:

(i) a squeeze bulb having an air vent formed therein;

(ii) a first check valve in fluid communication with said squeeze bulb and said reservoir for allowing air to flow from said squeeze bulb to said reservoir and not allowing fluid to flow from said reservoir to said squeeze bulb; and (iii) a second check valve in fluid communication with said reservoir and said fluid delivery means for allowing fluid to flow from said reservoir to said fluid delivery means and not allowing fluid to flow from said fluid delivery means to said reservoir.

2. The fluid dispensing wand as recited in claim 1 wherein the fluid reservoir defines a handle.

3. The fluid dispensing wand as recited in claim 2 wherein said handle is detachably attached to said wand member.

4. The fluid dispensing comb as recited in claim 3 further comprising:

(a) a seal formed upon said reservoir; and (b) a protuberance formed upon said wand member and configured to break said seal during the attachment of said wand member to said handle.

5. The fluid dispensing wand as recited in claim 1 further comprising a plurality of teeth extending from said wand member such that said fluid delivery means delivers fluid to said wand member proximate said teeth.

6. The fluid dispensing wand as recited in claim 1 further comprising a plurality of fins extending from said wand member such that said fluid delivery means delivers fluid to said wand member proximate said fins.

7. The fluid dispensing wand as recited in claim 1 further comprising an absorbent covering enveloping a substantial portion of said wand member such that fluid delivered by said fluid delivery means thereto is distributed evenly thereupon.

8. The fluid dispensing wand as recited in claim 1 further comprising a valve means for selectively controlling the flow of fluid from the reservoir to the fluid delivery means.

9. The fluid dispensing wand as recited in claim 8 wherein said valve means comprises at least one first conduit extending from said fluid reservoir and offset from an axis of rotation of said fluid reservoir and said wand member, and at least one second fluid conduit in fluid communication with said fluid delivery means formed in said wand member and offset from the axis of rotation of said fluid reservoir and said wand member wherein rotation of said wand member relative to said handle selectively places said first conduit and said second conduit in fluid intercommunication.

10. The fluid dispensing wand as recited in claim 8 wherein said valve means comprises a slide having an aperture formed therein such that the aperture aligns with a conduit extending from said reservoir to facilitate fluid intercommunication between said reservoir and said fluid deliver means.

11. The fluid dispensing wand as recited in claim 8 wherein said valve means comprises a rotating slide attached to said reservoir via a pivot, said slide having an aperture formed therein such that the aperture aligns with a conduit extending from said reservoir to facilitate fluid intercommunication between said reservoir and said fluid delivery means.

12. The fluid dispensing wand as recited in claim 8 wherein said valve means comprises a slide having a plug formed thereon such that said plug closes a conduit extending from said reservoir when said slide is disposed in a first position and does not close the conduit when said slide is disposed in a second position.

* * * * *